US010385654B2

(12) United States Patent
Gibb

(10) Patent No.: US 10,385,654 B2
(45) Date of Patent: Aug. 20, 2019

(54) SYSTEM AND METHOD FOR SEALING MULTILATERAL JUNCTIONS

(71) Applicant: CONOCOPHILLIPS COMPANY, Houston, TX (US)

(72) Inventor: John Gibb, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/933,819

(22) Filed: Mar. 23, 2018

(65) Prior Publication Data

US 2018/0274333 A1 Sep. 27, 2018

Related U.S. Application Data

(60) Provisional application No. 62/475,558, filed on Mar. 23, 2017.

(51) Int. Cl.

| | |
|---|---|
| ***E21B 33/13*** | (2006.01) |
| ***E21B 33/12*** | (2006.01) |
| ***E21B 36/02*** | (2006.01) |
| ***E21B 36/04*** | (2006.01) |
| ***E21B 41/00*** | (2006.01) |
| *E21B 36/00* | (2006.01) |

(52) U.S. Cl.

CPC ..... *E21B 33/13* (2013.01); *E21B 33/12* (2013.01); *E21B 41/0042* (2013.01); *E21B 36/008* (2013.01); *E21B 36/02* (2013.01); *E21B 36/04* (2013.01)

(58) Field of Classification Search

None

See application file for complete search history.

(56) References Cited

U.S. PATENT DOCUMENTS

| | | | | |
|---|---|---|---|---|
| 3,163,218 | A * | 12/1964 | Willman | E21B 33/138 166/205 |
| 3,208,530 | A * | 9/1965 | Allen | E21B 33/1204 166/123 |
| 3,273,641 | A * | 9/1966 | Bourne | E21B 33/134 166/205 |
| 3,333,635 | A | 8/1967 | Crawford | |
| 3,578,084 | A * | 5/1971 | Bombardieri | E21B 17/1028 166/241.6 |
| 3,765,486 | A | 10/1973 | Matthews et al. | |
| 4,484,750 | A | 11/1984 | Scruggs | |
| 4,487,432 | A | 12/1984 | Passerell et al. | |
| 4,873,895 | A | 10/1989 | Taylor et al. | |

(Continued)

OTHER PUBLICATIONS

International Search Report, PCT/US2018/023991 dated Jun. 11, 2018; 3 pgs.

*Primary Examiner* — Anuradha Ahuja
(74) *Attorney, Agent, or Firm* — Boulware & Valoir

(57) ABSTRACT

A system and method for sealing a multilateral junction in an oil well is described. Molten material, such as a eutectic or non-eutectic alloy, flows into the junction area and forms a durable seal upon cooling. An expanding alloy may be utilized, which expands upon solidification and which has a melting temperature that is higher than the maximum anticipated well temperature. The alloy is placed within a cavity in the well and held at a temperature above the melting point of the alloy, after which the alloy is cooled down to the ambient well temperature and solidifies and expands within the cavity.

7 Claims, 6 Drawing Sheets

(56) References Cited

U.S. PATENT DOCUMENTS

| | | | | |
|---|---|---|---|---|
| 5,137,283 | A | 8/1992 | Giarrusso et al. | |
| 5,388,648 | A * | 2/1995 | Jordan, Jr. | E21B 7/061 166/117.5 |
| 6,012,526 | A * | 1/2000 | Jennings | E21B 7/061 166/297 |
| 6,199,633 | B1 * | 3/2001 | Longbottom | E21B 7/04 166/117.6 |
| 6,419,026 | B1 * | 7/2002 | MacKenzie | E21B 41/0042 166/206 |
| 6,474,414 | B1 * | 11/2002 | Gonzalez | E21B 33/14 166/192 |
| 6,664,522 | B2 | 12/2003 | Spencer | |
| 6,828,531 | B2 | 12/2004 | Spencer | |
| 6,923,263 | B2 * | 8/2005 | Eden | C09K 8/42 166/179 |
| 7,152,657 | B2 | 12/2006 | Bosma et al. | |
| 7,207,390 | B1 | 4/2007 | Pratt | |
| 7,290,609 | B2 | 11/2007 | Wardlaw et al. | |
| 2002/0056553 | A1 * | 5/2002 | Duhon | E21B 36/04 166/302 |
| 2003/0132224 | A1 | 7/2003 | Spencer | |
| 2004/0149418 | A1 * | 8/2004 | Bosma | E21B 29/10 164/98 |
| 2005/0167109 | A1 * | 8/2005 | Hepburn | E21B 41/0042 166/313 |
| 2006/0124360 | A1 * | 6/2006 | Lee | E21B 43/305 175/61 |
| 2007/0137826 | A1 * | 6/2007 | Bosma | E21B 29/10 164/80 |
| 2015/0101813 | A1 | 4/2015 | Zhao et al. | |
| 2018/0216431 | A1 * | 8/2018 | Walton, III | E21B 23/06 |

* cited by examiner

SYSTEM AND METHOD FOR SEALING MULTILATERAL JUNCTIONS

CROSS-REFERENCE TO RELATED APPLICATIONS

This application is a non-provisional application which claims benefit under 35 USC § 119(e) to U.S. Provisional Application Ser. No. 62/475,558 filed Mar. 23, 2017, entitled "SYSTEM AND METHOD FOR SEALING MULTILATERAL JUNCTIONS," which is incorporated herein in its entirety.

STATEMENT REGARDING FEDERALLY SPONSORED RESEARCH

None.

FIELD OF THE INVENTION

The present disclosure relates in general to the field of hydrocarbon drilling. More particularly, but not by way of limitation, embodiments of the present invention relate to a system and method for improved sealing of multilateral well junctions.

BACKGROUND OF THE INVENTION

Multilateral completion systems allow the drilling and completion of multiple wells within a single wellbore. In addition to the main wellbore, there are one or more lateral wells extending from the main wellbore. This allows for alternative well-construction strategies for vertical, inclined, horizontal, and extended-reach wells. Multilaterals can be constructed in both new and existing oil and gas wells. A typical installation includes two laterals; the number of laterals would be determined by: the number of targets, depths/pressures, risk analysis, and well-construction parameters.

Multilateral systems combine the advantages of horizontal-drilling techniques with the ability to achieve multiple target zones. The advantages of horizontal drilling include: higher production indices, the possibility of draining relatively thin formation layers, decreased water and gas coning, increased exposure to natural fracture systems in the formation, and better sweep efficiencies.

Depending on the type of multilateral design used, the target zones can be isolated and produced independently—or produced simultaneously, if commingled production is allowed or if a parallel string completion is used.

However, while there are multiple multilateral designs available, many are complex and expensive to implement, and there remains a critical need to ensure the use of such multilateral junctions in a wide array of wells, while maintaining hydraulic and mechanical integrity.

BRIEF SUMMARY OF THE DISCLOSURE

The present invention addresses limitations in the art by providing a system and method for an economical and reliable alternative alloy-based molten material to be delivered to a multilateral junction, wherein the molten materials, such as a eutectic or non-eutectic alloy, is flowed into the junction area and forms a durable seal upon cooling.

In one aspect a method for sealing a multilateral well junction is provided, comprising: running a tool for delivering a metal to a selected depth proximal to a multilateral junction; increasing the temperature of the metal above the melting point of the metal; distributing the molten metal within an annulus comprising the multilateral junction; and solidifying the molten metal by reducing the temperature of the metal. The annulus is between a tubular and the casing of the multilateral junction. Alternatively, the annulus is outside the casing of the multilateral junction.

In one aspect, the metal utilized comprises bismuth or a bismuth-containing alloy. A tool which comprises a plug comprising a metal and a heating element for heating the plug, upon which the metal becomes molten at the desired location within the multilateral junction. Subsequently, a reduction of the temperature occurs upon distribution of the molten metal within the annulus.

It is another object of the present invention to provide a multilateral junction seal, comprising a metal distributed within the annulus around a multilateral junction, said metal being cast in a molten state, wherein a seal is formed around the multilateral junctions upon the solidification of the metal. One or more packers may be present below the multilateral junction for forming a basal barrier for the flow of molten metal. The present invention provides for a seal which contains hydraulic and mechanical integrity.

BRIEF DESCRIPTION OF THE DRAWINGS

The foregoing and other objects, features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure.

DETAILED DESCRIPTION OF THE DISCLOSURE

Figure 1A:
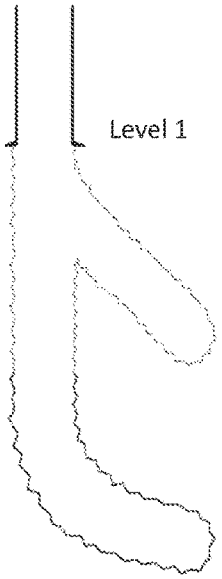
FIG. 1A-C depicts Level 1 through Level 3 multilateral wells as classified by the Technology Advancement of MultiLaterals (TAML).

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

The present disclosure will now be described more fully hereinafter with reference to the accompanying figures and drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Multilateral wells in their most simple form have been utilized in the oil and gas industry since the 1950's. These early multilateral systems, however, were only suitable in their application to a small segment of wells. While completion techniques have improved significantly, it remains a challenge to determine what type of multilateral, if any, is best suited to the reservoir and production demands. When considering a multilateral completion, several aspects are relevant. The goal of the multilateral system is to maximize production from the reservoir with a minimum increase in drilling and completion costs. This requirement can be satisfied directing all production bores located in a single producing formation. This allows an optimized drainage pattern, greater fracture exposure, and a decreased probability of water or gas coning due to drawdown. Another approach is to complete with the production bores located in separate producing formations. This allows marginal formations to be produced that otherwise could not be economically completed.

In most cases, a multilateral well will cost more to construct than a single vertical or horizontal bore. Economic benefits will be derived primarily from increased production and/or reserves. To ensure such benefits, it is vitally important to have a thorough knowledge and understanding of the reservoir mechanics, and to use that knowledge and understanding to design multilateral completions from the reservoir up.

As with conventional wells, the wellbore stability must be considered when choosing whether or not to case the hole. In addition, with a multilateral system, the geology at the junction of the lateral bores must also be closely scrutinized. The most flexible multilateral completions are those designed with the junction kick-off point located in a strong, competent, consolidated formation. However, if geology or other downhole conditions preclude this ideal scenario, mechanical support and, perhaps, hydraulic isolation must be included as part of the completion design.

Even if the lateral junction is initially competent, the completion design must take into consideration how the formation will respond as the well is produced and pressure drawdown occurs. It is not enough to just provide support during the initial few months of the well production; multilaterals must be designed for the life of the well. If the junction formation cannot retain its integrity as pressure drawdown occurs, hydraulic isolation of the junction may need to be considered.

Production mechanics, as well as regulatory and environmental requirements, exert strong influence on multilateral completion design, particularly as regards zonal isolation. Any of these factors, either individually or in combination, may necessitate isolated, dual-string production to surface when the production is from multiple reservoirs. On the other hand, casing and tubular sizing and uphole equipment needs often dictate that production be commingled at the lateral junction and produced up a single string.

The various degrees of multilateral systems have been categorized by the Technology Advancement of MultiLaterals (TAML), a group of operators and suppliers with experience in developing multilateral technology. The TAML system for multilateral-well classification is based on the amount and type (or absence) of support provided at the lateral junction. There are six industry levels defined by TAML. This categorization system makes it easier for operators to recognize and compare the functionality and risk-to-reward evaluations of one multilateral completion design to another. As the TAML level increases, so does the complexity and cost of the system.

TAML level 1. The most fundamental multilateral system consists of an openhole main bore with multiple drainage legs (or laterals) exiting from it (FIG. 1A). The junction in this design is left with no mechanical support or hydraulic isolation. The integrity of the junction is dependent on natural borehole stability, but it is possible to land a slotted liner in the lateral or the main bore to help keep the hole open during production. The production from a Level 1 system must be commingled, and zonal isolation or selective control of production is not possible. Re-entry into either the main bore or the lateral may be difficult or impossible should well intervention be required in the future.

Figure 1B:
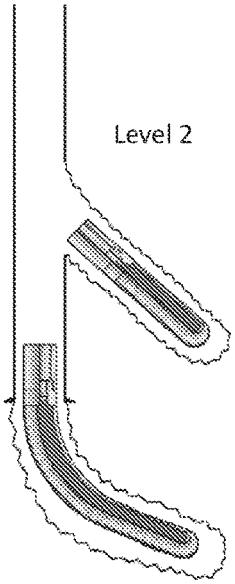

TAML level 2. This system is similar to Level 1, with the exception that the laterals are drilled off of a cased and cemented main bore (FIG. 1B). The cased main bore minimizes the chances of borehole collapse and provides a means of hydraulic isolation between zones. As with Level 1, there is no actual mechanical support of the lateral junction, but it is possible to run a slotted liner into the lateral to maintain borehole stability.

Figure 1C:
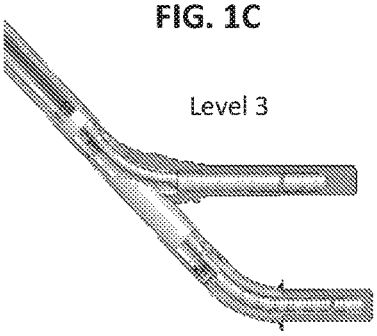

TAML level 3. The Level 3 system also uses a cased and cemented main bore with an openhole lateral (FIG. 1C). However, in this design, a slotted liner or screen is set in the lateral and anchored back into the main bore. This system offers mechanical support of the lateral junction, but the advantage of hydraulic isolation is lost, and the zones must be commingled to be produced. The production from the zone below the junction must flow through the whipstock assembly and past the slotted liner to reach the main bore. This system provides easy access into the lateral for coiled-tubing assemblies, but re-entry into the main bore below the junction is not possible.

Figure 2A:
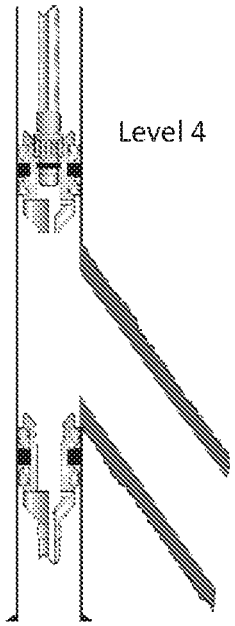
FIG. 2A-C depicts Level 4 through Level 6 multilateral wells as classified by the TAML.

TAML level 4. This system offers both a cased and a cemented main bore and lateral (FIG. 2A). This gives the lateral excellent mechanical support, but the cement itself does not offer pressure integrity at the junction. While the cement does protect the junction from sand infiltration and potential collapse, it is not capable of withstanding more than a few hundred psi of differential. There is a potential for failure if the junction is subjected to a pressure drawdown, as might be experienced in an electrical submersible pump (ESP) application. Zonal isolation and selectivity is possible by installing packers above and below the junction in the main bore. Systems are available that also offer coiled-tubing intervention, both into the lateral and into the main bore below the junction.

Figure 2B:
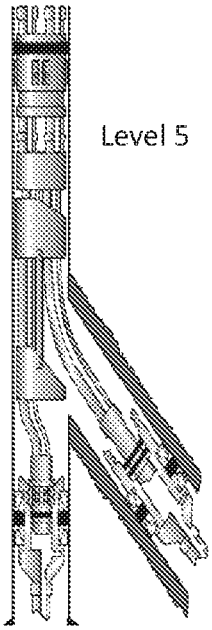

TAML level 5. The Level 5 multilateral is similar in construction to the Level 4 in that it has both a cased and a cemented main bore and lateral, which offers the same level of mechanical integrity (FIG. 2B). The difference is that pressure integrity has now been achieved by using tubing strings and packers to isolate the junction. Single-string packers are placed in both the main bore and lateral below the junction and connected by tubing strings to a dual-string isolation packer located above the junction in the main bore. This system offers full access to both the main bore and the lateral. The zones can be produced independent of one another, or the completion can be designed to allow them to be commingled.

Figure 2C:
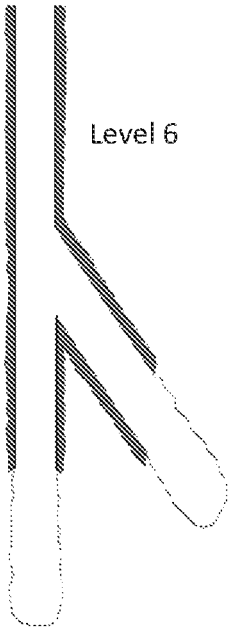

TAML level 6. In the Level 6 multilateral system, both mechanical and pressure integrity are achieved by using the casing to seal the junction (FIG. 2C). Cementing the junction, as was done in the Level 4 system, is not acceptable. The Level 6 system uses a pre-manufactured junction. In one type of system, the junction is reformed downhole. In another, two separate wells are drilled out of a single main bore, and the pre-manufactured junction is assembled downhole.

Multilateral junctions, particularly TAML levels 4, 5, and 6, must provide both mechanical and hydraulic integrity. Currently these junctions are complex and expensive, and they are not often cost-effective for land operations.

The present invention provides an economical and reliable alternative by allowing for an alloy-based molten material to be delivered to the multilateral junction, wherein the molten materials, such as a eutectic or non-eutectic alloy, is flowed into the junction area and forms a durable seal upon cooling. In an embodiment, an expanding alloy is used, which expands upon solidification and which has a melting temperature that is higher than the maximum anticipated well temperature, which alloy is placed within a cavity in the well and held at a temperature above the melting point of the alloy, whereupon the alloy is cooled down to the ambient well temperature and thereby solidifies and expands within the cavity.

In a preferred embodiment the expanding alloy comprises bismuth. In an alternative embodiment, the expanding alloy comprises gallium or antimony. It is well-known that bismuth compositions with a low melting point and which expand during cooling down from U.S. Pat. Nos. 7,290,609; 7,152,657; 6,828,531; 6,664,522; 6,474,414; 5,137,283; 4,873,895; 4,487,432; 4,484,750; 3,765,486; 3,578,084; 3,333,635 and 3,273,641 all of which are hereby incorporated by reference, and may be utilized in situations ranging from well abandonment to other equipment casting activities, which may take place entirely downhole.

Low-melting or fusible alloys, also known as eutectic and non-eutectic alloys, are generally the alloys that melt below 450° F. (233° C.). The most useful are the alloys containing high percentages of bismuth combined with lead, tin, cadmium, indium and other metals. The low melting temperature and unique growth/shrinkage characteristics of these alloys lead to a greater diversity in useful applications than almost any other alloy system. Commercially available alloys include Rose's Metal (50% Bi, 28% Pb, 22% Sn), Wood's Metal (50% Bi, 25% Pb, 12.5% Sn, 12.5% Cd), Field's Metal (32% Bi, 51% In, 17% Sn), Lipowitz's alloy (50% Bi, 27% Pb, 13% Sn, 10% Cd), Newton's Metal (50% Bi, 31% Pb, 19% Sn), Onions' Fusible Alloy (50% Bi, 30% Pb, 20% Sn), Tin Foil (92% Sn, 8% Zn), Cerrosafe (42.5% Bi, 38% Pb, 11% Sn, 9% Cd), Cerrobend (50% Bi, 27% Pb, 13% Sn, 10% Cd), Cerrolow 136 (49% Bi, 18% Pb, 21% In, 12% Sn), and Cerrolow 117 (45% Bi, 23% Pb, 19% In, 5% Cd, 8% Sn). One common low melting allow is a bismuth (40%), lead (22%), tin (11%), cadmium (8%), indium (17%), thallium (1%) alloy which melts at approximately 107° F. (41.5° C.). In another embodiment a simple solder may be used such as Sn63 (63% Sn, 37% Pb), Bi58 (58% Bi, 42% Sn), or Bi52 (52% Bi, 32% Pb, 16% Sn). All percentages may be approximated or modified to alter the properties of the alloy including melting point, strength, fatigue, resistance to corrosiveness, and bonding properties to casing materials. In another embodiment tin, bismuth, lead or other metal may be used alone due to their relatively low melting points.

Eutectic alloys have two or more materials and have a eutectic composition. When a non-eutectic alloy solidifies, its components solidify at different temperatures, exhibiting a plastic melting range. Conversely, when a well-mixed, eutectic alloy melts, it does so at a single, sharp temperature. The various phase transformations that occur during the solidification of a particular alloy composition can be understood by drawing a vertical line from the liquid phase to the solid phase on the phase diagram for that alloy.

It is a preferred embodiment of the present invention to utilize a molten alloy for purposes of sealing a multilateral junction. The seal allows for proper function and operation of the multilateral junction, which requires provides both mechanical and hydraulic integrity. Many of the TAML levels, particularly 4, 5, and 6, are complex and expensive, not suitable for land operations. Utilization of an expandable alloy, which expands upon solidification and which has a melting temperature that is higher than the maximum anticipated well temperature, is placed within a cavity in the well and held at a temperature above the melting point of the alloy, whereupon the alloy is cooled down to the ambient well temperature and thereby solidifies and expands within the cavity. A body may be used to serve as a molding structure, such as a tubular that forms an annular cavity between the tubular and the well casing, or exterior. The alloy may then be delivered to the annular space for solidification by reducing the temperature of the molten alloy.

Figure 3:
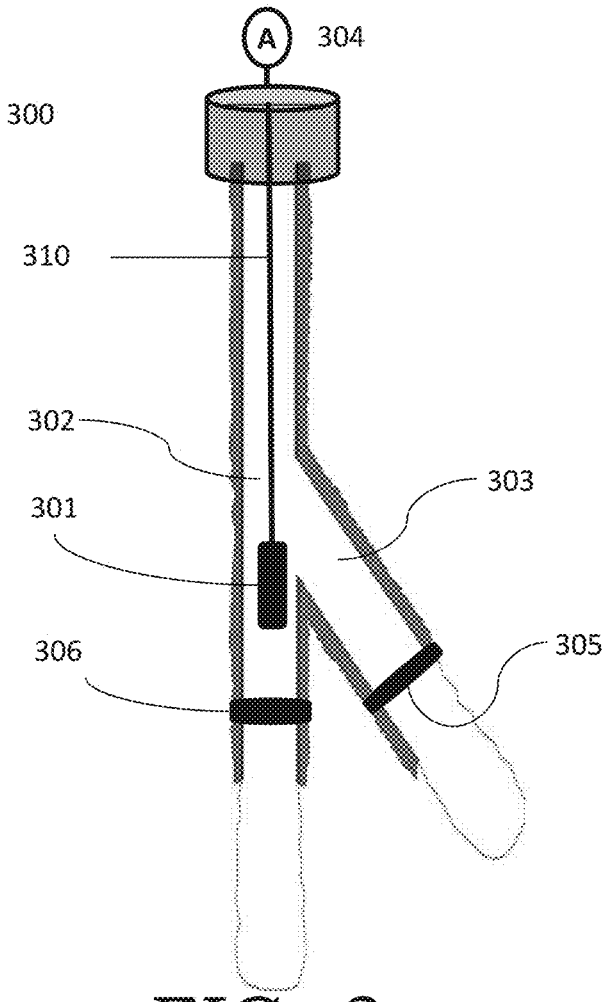
FIG. 3 depicts a multilateral well having a tool dispatched in accordance with the present invention
Figure 4:
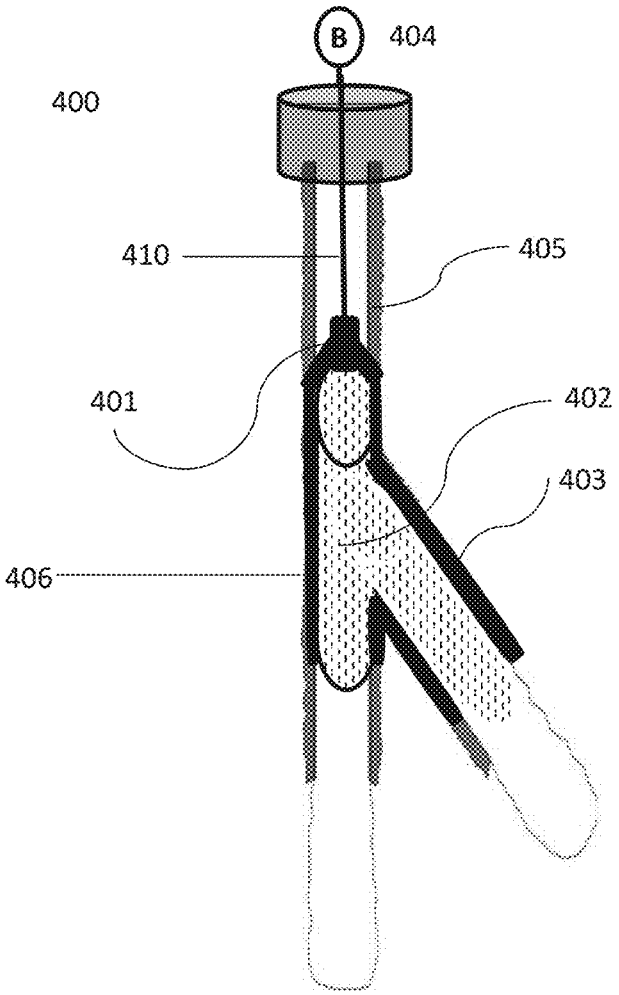
FIG. 4 depicts a multilateral well having a seal cast within the annulus of a multilateral junction.
Figure 5:
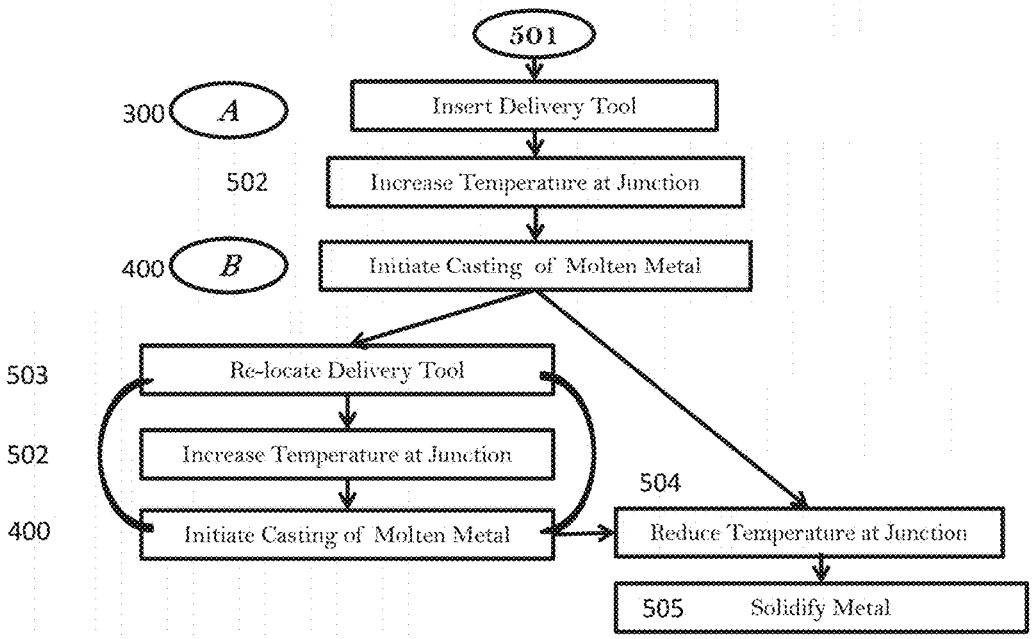
FIG. 5 depicts a flow diagram of an exemplary embodiment of the present invention.
Figure 6:
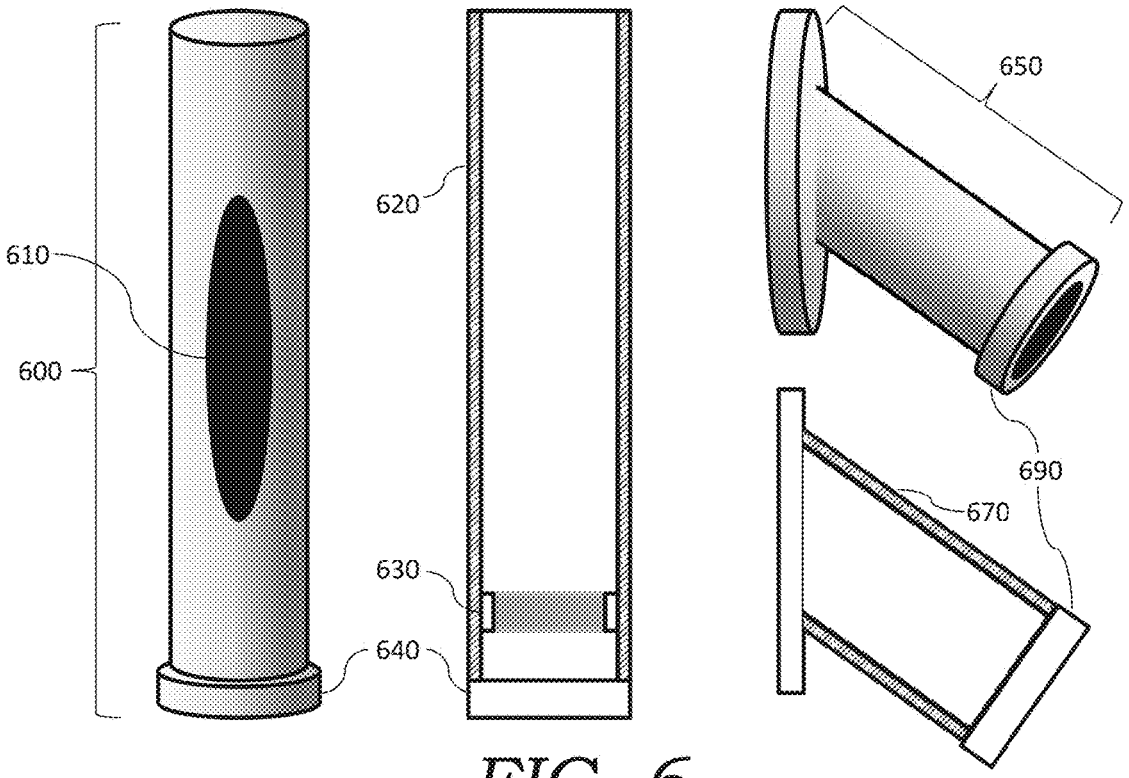
FIG. 6 depicts a prefabricated pipe section containing a window and a junction section fabricated to align with the window.

Turning to FIGS. 3-5, illustrative embodiments of exemplary prior art and the protective tubing system of the present invention are provided. FIG. 3 shows a multilateral junction within a hydrocarbon wellbore 300 having a primary wellbore 302 having a lateral wellbore 303 which intersects the primary wellbore 302. The multilateral junction requires hydraulic and mechanical integrity. A tool 301 is run in hole via the wellhead 304 to the desired depth at the multilateral junction. The tool is provided control by line 310 having various instrumentation, which may further include a heating element. In one embodiment, packers 305, 306 may be placed at the bottom of the primary wellbore 302 and lateral wellbore 303 to ensure that molten metal does not drain below the desired location for casting.

FIG. 4 presents a multilateral junction 400 within a wellbore, wherein the controlled casting of molten metal within the desired multilateral junction is achieved. The suspended tool 402 controlled by a controller 404 allows for the temperature of the downhole tool 402 to increase, thus melting the metal dispatched at the multilateral junction. The molten metal distributes into the annulus located within the multilateral junction 403, 406. In order to create an effective seal, a form, such as a tubular 402 may be dispatched in hole for purposes of molding the molten metal in the annular space 403, 406 external to the tubular 402. As with FIG. 3, packers (not shown) may be set beneath the multilateral junction to contain the molten metal while in the molten state.

In one embodiment a method 501 of providing a multilateral junction having a seal comprised of solidifying a molten metal, such as a bismuth containing alloy, presented to the junction by inserting a delivery tool 300, as step "A" set forth in FIG. 3, wherein the temperature is increased 502 by the tool dispatched at the junction. The molten metal is then cast 400, as step "B" set forth in FIG. 4, wherein the molten metal is dispatched into the annulus of the multilateral junction. Following the casting, the temperature at the junction is reduced 504, wherein the molten metal is solidified 505, forming a seal at the multilateral junction. The process may be repeated by having the delivery tool relocated 503, wherein the increase of the temperature 502 and casting 400 of the molten metal may occur.

In another embodiment a prefabricated section of liner 600 containing a window 610 is coated with low melting sleeve 620 to create a solid section of liner. The liner is manufactured with a whipstock profile 630 to assist with landing and directing the whipstock to the window. Once the liner is at a desired depth and direction in the well, a heater is placed inside the prefabricated liner, melting the metal leaving the open window. The molten metal catches on the exterior lip 640, solidifying and creating a solid seal between the liner and well bore. Once the window is opened, the sidewell may be drilled to any length. Once sidewell drilling is completed, a prefabricated junction 650 with a low melting sleeve 670 is installed. The heater placed in the junction 650 melting the low melting sleeve 670. The molten metal catching on the exterior lip 690 of the junction. The junction may optionally have an upper lip 660 that catches on or aligns with the window 610 of the liner 600. Once the liner and the junction are bonded to the wellbore, additional low melting metal or cement may be placed around the junction. In one embodiment additional metal sleeve (not shown) is placed above the window 610 that may be melted by the heater as it is removed from the junction. In an alternative embodiment, additional metal is added to the exterior of the liner while the heater is in the junction. In either case a junction is formed with a complete seal above, below and around the window.

The use of a prefabricated window that is cleared by melting the low melting metal provides a junction that is close to or may even be the same size as the original liner. Because there is no milling required and a heater is used to remove the low melting alloy, the shape and size of the window are defined during fabrication and no mill-out is required. The low melting metal may be removed with a torch, resistive heater, chemical heater, or other heater dependent upon the melting point and conditions in the wellbore. The junction may be fabricated to fit the window precisely because the window will not have any roughness, metal fragments or other imperfections.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

What is claimed is:

1. A method for sealing a multilateral well junction, comprising:

(a) installing a prefabricated liner comprising a window with a metal sleeve in a well bore wherein the sleeve creates a solid section of a liner over said window;

(b) increasing a temperature of the metal sleeve of the prefabricated liner with a heater to form molten metal and open said window;

(c) distributing the molten metal of the metal sleeve of the prefabricated liner within an annulus between said prefabricated liner and said wellbore;

(d) solidifying the molten metal of the metal sleeve of the prefabricated liner by reducing the temperature of said molten metal;

(e) drilling a sidewell through said opened window;

(f) installing a prefabricated junction at said opened window to form a multilateral well junction, said prefabricated junction comprising a metal sleeve;

(g) increasing a temperature of the metal sleeve of the prefabricated junction with said heater to form a molten metal;

(h) distributing the molten metal of the metal sleeve of the prefabricated junction within an annulus at said multilateral well junction; and (i) solidifying the molten metal of the metal sleeve of the prefabricated junction by reducing the temperature of said molten metal to form a seal, thereby sealing said multilateral well junction.

2. The method of claim 1, wherein the metal sleeves comprise bismuth, lead, tin, cadmium, indium, thallium, or a combination thereof.

3. The method of claim 1, wherein the metal sleeves comprises one of the following alloys selected from 50% Bi, 28% Pb, and 22% Sn; 50% Bi, 25% Pb, 12.5% Sn, and 12.5% Cd; 32% Bi, 51% In, and 17% Sn; 50% Bi, 27% Pb, 13% Sn, and 10% Cd; 50% Bi, 31% Pb, and 19% Sn; 50% Bi, 30% Pb, and 20% Sn; 92% Sn, and 8% Zn; 42.5% Bi, 38% Pb, 11% Sn, and 9% Cd; 50% Bi, 27% Pb, 13% Sn, and 10% Cd; 49% Bi, 18% Pb, 21% In, and 12% Sn; 45% Bi, 23% Pb, 19% In, 5% Cd, and 8% Sn; 40% Bi, 22% Pb, 11% Sn, 8% Cd, 17% In, and 1% Tl; 63% Sn and 37% Pb; 58% Bi; and 42% Sn; or 52% Bi, 32% Pb, and 16% Sn.

4. The method of claim 1, wherein said heater comprises a torch, a resistive heater, or a chemical heater.

5. The method of claim 1, wherein the reduction of the temperature in steps (d) and (i) occurs upon distribution of the molten metal upon an exterior lip or within the annulus.

6. The method of claim 1, wherein one or more packers are present below the multilateral well junction for forming a basal barrier for the molten metal.

7. The method of claim 1, wherein the seal further comprises hydraulic and mechanical integrity.

* * * * *